US010618697B2

(12) United States Patent
Price et al.

(10) Patent No.: US 10,618,697 B2
(45) **Date of Patent: *Apr. 14, 2020**

(54) RECLOSABLE POUCH HAVING A CLICKING CLOSURE DEVICE

(71) Applicant: S.C. Johnson & Son, Inc., Racine, WI (US)

(72) Inventors: William D. Price, Midland, MI (US); Richard R. Dawkins, Saginaw, MI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/993,796

(22) Filed: May 31, 2018

(65) Prior Publication Data

US 2018/0273250 A1 Sep. 27, 2018

Related U.S. Application Data

(63) Continuation of application No. 15/272,762, filed on Sep. 22, 2016, now Pat. No. 10,011,396, which is a continuation of application No. 14/813,326, filed on Jul. 30, 2015, now Pat. No. 9,475,616, which is a continuation of application No. 14/039,041, filed on Sep. 27, 2013, now Pat. No. 9,126,735, which is a (Continued)

(51) Int. Cl.

| | |
|---|---|
| ***B65D 33/25*** | (2006.01) |
| ***B65D 33/24*** | (2006.01) |
| ***B65D 75/58*** | (2006.01) |

(52) U.S. Cl.

CPC ..... *B65D 33/255* (2013.01); *B65D 33/24* (2013.01); *B65D 33/2558* (2013.01); *B65D 33/2566* (2013.01); *B65D 75/5855* (2013.01); *B65D 2203/12* (2013.01); *Y10T 24/2534* (2015.01)

(58) Field of Classification Search

CPC .. B65D 33/255; B65D 33/24; B65D 33/2558; B65D 33/2566; B65D 75/5855

USPC ..... 383/63

See application file for complete search history.

(56) References Cited

U.S. PATENT DOCUMENTS

| | | | |
|---|---|---|---|
| 2,035,674 | A | 3/1936 | Sipe |
| 2,822,012 | A | 2/1958 | Gold |

(Continued)

FOREIGN PATENT DOCUMENTS

| | | | |
|---|---|---|---|
| DE | 1226817 | B | 10/1966 |
| DE | 2504863 | A1 | 8/1976 |
| WO | WO 86/00867 | A1 | 2/1986 |

*Primary Examiner* — Jes F Pascua

(57) ABSTRACT

A reclosable pouch includes a first bag wall. A second bag wall opposing the first bag wall is joined to the first bag wall to form an interior of the pouch with an opening to the interior. A male closure element coupled to one of the bag walls defines a plurality of deformed segments and a plurality of normal segments along a length thereof. The plurality of deformed segments alternate with the plurality of normal segments, with (i) first transitions on one side of the male closure element and (ii) second transitions on another side of the male closure element. A female closure element coupled to the other bag wall engages with the male closure element to seal the opening of the pouch, with the deformed segments of the male closure element generating a sound when the female closure element engages with the male closure element.

21 Claims, 7 Drawing Sheets

Related U.S. Application Data continuation of application No. 13/031,984, filed on Feb. 22, 2011, now Pat. No. 8,568,031.

(56) References Cited

U.S. PATENT DOCUMENTS

| | | | |
|---|---|---|---|
| 3,338,284 | A | 8/1967 | Ausnit |
| 3,381,592 | A | 5/1968 | Ravel |
| 3,416,585 | A | 12/1968 | Steller |
| 3,565,147 | A | 2/1971 | Ausnit |
| RE27,174 | E | 9/1971 | Ausnit |
| 3,937,395 | A | 2/1976 | Lawes |
| RE28,969 | E | 9/1976 | Naito |
| 4,186,786 | A | 2/1980 | Kirkpatrick |
| 4,191,076 | A | 3/1980 | Bollmer et al. |
| 4,285,105 | A | 8/1981 | Kirkpatrick |
| 4,285,376 | A | 8/1981 | Ausnit |
| 4,363,345 | A | 12/1982 | Scheibner |
| 4,372,014 | A | 2/1983 | Simpson |
| 4,419,159 | A | 12/1983 | Herrington |
| 4,428,788 | A | 1/1984 | Kamp |
| 4,479,244 | A | 10/1984 | Ausnit |
| 4,484,352 | A | 11/1984 | Katzin |
| 4,515,647 | A | 5/1985 | Behr |
| 4,522,678 | A | 6/1985 | Zieke |
| 4,532,652 | A | 7/1985 | Herrington |
| 4,555,282 | A | 11/1985 | Yano |
| 4,561,108 | A | 12/1985 | Kamp |
| 4,561,109 | A | 12/1985 | Herrington |
| 4,562,027 | A | 12/1985 | Behr et al. |
| 4,578,813 | A | 3/1986 | Ausnit |
| 4,586,319 | A | 5/1986 | Ausnit |
| 4,615,045 | A | 9/1986 | Siegel |
| 4,618,383 | A | 10/1986 | Herrington |
| 4,655,862 | A | 4/1987 | Christoff et al. |
| 4,672,723 | A | 6/1987 | Hugues et al. |
| 4,673,383 | A | 6/1987 | Bentsen |
| 4,676,851 | A | 6/1987 | Scheibner et al. |
| 4,683,015 | A | 7/1987 | Wagers |
| 4,698,118 | A | 10/1987 | Takahashi |
| 4,701,358 | A | 10/1987 | Behr et al. |
| 4,709,399 | A | 11/1987 | Sanders |
| 4,709,400 | A | 11/1987 | Bruno |
| 4,710,968 | A | 12/1987 | Borchardt et al. |
| 4,736,451 | A | 4/1988 | Ausnit |
| 4,736,496 | A | 4/1988 | Fisher et al. |
| 4,741,789 | A | 5/1988 | Zieke et al. |
| 4,755,248 | A | 7/1988 | Geiger et al. |
| 4,764,977 | A | 8/1988 | Wagers |
| 4,787,880 | A | 11/1988 | Ausnit |
| 4,788,282 | A | 11/1988 | Deziel |
| 4,791,710 | A | 12/1988 | Nocek et al. |
| 4,792,240 | A | 12/1988 | Ausnit |
| 4,796,300 | A | 1/1989 | Branson |
| 4,812,056 | A | 3/1989 | Zieke |
| 4,812,192 | A | 3/1989 | Woods et al. |
| 4,822,539 | A | 4/1989 | Tilman et al. |
| 4,829,641 | A | 5/1989 | Williams |
| 4,832,768 | A | 5/1989 | Takahashi |
| 4,834,554 | A | 5/1989 | Stetler, Jr. et al. |
| 4,846,586 | A | 7/1989 | Bruno |
| 4,859,259 | A | 8/1989 | Scheibner |
| 4,869,725 | A | 9/1989 | Schneider et al. |
| 4,898,492 | A | 2/1990 | Janowski |
| 4,906,310 | A | 3/1990 | Broderick et al. |
| 4,907,321 | A | 3/1990 | Williams |
| 4,923,701 | A | 5/1990 | VanErden |
| 4,941,238 | A | 7/1990 | Clark |
| 4,964,739 | A | 10/1990 | Branson et al. |
| 5,009,828 | A | 4/1991 | McCree |
| 5,012,561 | A | 5/1991 | Porchia et al. |
| 5,017,021 | A | 5/1991 | Simonsen et al. |
| 5,022,530 | A | 6/1991 | Zieke |
| 5,023,122 | A | 6/1991 | Boeckmann et al. |
| RE33,674 | E | 8/1991 | Uramoto |
| 5,049,223 | A | 9/1991 | Dais et al. |
| 5,053,091 | A | 10/1991 | Giljam et al. |
| 5,056,933 | A | 10/1991 | Kamp |
| 5,067,822 | A | 11/1991 | Wirth et al. |
| 5,070,584 | A | 12/1991 | Dais et al. |
| 5,092,684 | A | 3/1992 | Weeks |
| 5,138,750 | A | 8/1992 | Gundlach et al. |
| 5,140,727 | A | 8/1992 | Dais et al. |
| 5,141,577 | A | 8/1992 | Porchia et al. |
| 5,154,086 | A | 10/1992 | Porchia et al. |
| 5,167,454 | A | 12/1992 | Woods et al. |
| 5,184,896 | A | 2/1993 | Hammond et al. |
| 5,186,543 | A | 2/1993 | Cochran |
| 5,192,135 | A | 3/1993 | Woods et al. |
| 5,198,055 | A | 3/1993 | Wirth et al. |
| 5,209,574 | A | 5/1993 | Tilman |
| 5,211,481 | A | 5/1993 | Tilman |
| 5,235,731 | A | 8/1993 | Anzai et al. |
| 5,238,306 | A | 8/1993 | Heintz et al. |
| 5,248,201 | A | 9/1993 | Kettner et al. |
| 5,252,281 | A | 10/1993 | Kettner et al. |
| 5,259,904 | A | 11/1993 | Ausnit |
| 5,273,511 | A | 12/1993 | Boeckman |
| 5,307,552 | A | 5/1994 | Dais et al. |
| 5,326,176 | A | 7/1994 | Domke |
| 5,345,659 | A | 9/1994 | Allan |
| 5,356,222 | A | 10/1994 | Kettner et al. |
| 5,358,334 | A | 10/1994 | Simonsen |
| 5,366,294 | A | 11/1994 | Wirth et al. |
| 5,368,394 | A | 11/1994 | Scott et al. |
| 5,369,847 | A | 12/1994 | Naya et al. |
| 5,382,094 | A | 1/1995 | Ausnit |
| 5,384,942 | A | 1/1995 | Siegel |
| 5,388,910 | A | 2/1995 | Koyanagi |
| 5,397,182 | A | 3/1995 | Gaible et al. |
| 5,403,094 | A | 4/1995 | Tomic |
| 5,405,561 | A | 4/1995 | Dais et al. |
| 5,415,904 | A | 5/1995 | Takubo et al. |
| 5,462,360 | A | 10/1995 | Tilman et al. |
| 5,474,382 | A | 12/1995 | May |
| 5,478,228 | A | 12/1995 | Dais et al. |
| 5,492,705 | A | 2/1996 | Porchia et al. |
| 5,509,734 | A | 4/1996 | Ausnit |
| 5,511,884 | A | 4/1996 | Bruno et al. |
| 5,525,363 | A | 6/1996 | Herber et al. |
| 5,527,112 | A | 6/1996 | Dais et al. |
| 5,540,500 | A | 7/1996 | Tanaka |
| 5,558,493 | A | 9/1996 | Hayashi et al. |
| 5,564,834 | A | 10/1996 | Porchia et al. |
| 5,575,747 | A | 11/1996 | Dais et al. |
| 5,577,305 | A | 11/1996 | Johnson |
| 5,588,187 | A | 12/1996 | Swain |
| 5,611,627 | A | 3/1997 | Belias et al. |
| 5,618,111 | A | 4/1997 | Porchia et al. |
| 5,647,100 | A | 7/1997 | Porchia et al. |
| 5,655,273 | A | 8/1997 | Tomic et al. |
| 5,660,479 | A | 8/1997 | May et al. |
| 5,664,299 | A | 9/1997 | Porchia et al. |
| 5,669,715 | A | 9/1997 | Dobreski et al. |
| 5,672,009 | A | 9/1997 | Malin |
| 5,686,126 | A | 11/1997 | Noel et al. |
| 5,689,866 | A | 11/1997 | Kasai et al. |
| 5,704,670 | A | 1/1998 | Surplus |
| 5,711,609 | A | 1/1998 | Simonsen |
| 5,713,669 | A | 2/1998 | Thomas et al. |
| 5,718,024 | A | 2/1998 | Robbins |
| 5,720,557 | A | 2/1998 | Simonsen |
| 5,722,128 | A | 3/1998 | Toney et al. |
| 5,729,876 | A | 3/1998 | Johnson |
| 5,747,126 | A | 5/1998 | Van Erden et al. |
| 5,749,658 | A | 5/1998 | Kettner |
| 5,769,772 | A | 6/1998 | Wiley |
| 5,774,955 | A | 7/1998 | Borchardt et al. |
| 5,775,812 | A | 7/1998 | St. Phillips et al. |
| 5,783,012 | A | 7/1998 | Porchia et al. |
| 5,791,783 | A | 8/1998 | Porchia et al. |
| 5,794,315 | A | 8/1998 | Crabtree et al. |
| 5,804,265 | A | 9/1998 | Saad et al. |
| 5,809,621 | A | 9/1998 | McCree et al. |
| 5,817,380 | A | 10/1998 | Tanaka |

(56) References Cited

U.S. PATENT DOCUMENTS 5,827,163 A 10/1998 Kettner
5,832,145 A 11/1998 Dais et al.
5,832,570 A 11/1998 Thorpe et al.
5,836,056 A 11/1998 Porchia et al.
5,839,831 A 11/1998 Mazzocchi
D406,685 S 3/1999 McGinnis
5,878,468 A 3/1999 Tomic et al.
5,902,046 A 5/1999 Shibata
5,911,508 A 6/1999 Dobreski et al.
5,927,855 A 7/1999 Tomic et al.
5,930,877 A 8/1999 Thorpe et al.
5,933,927 A 8/1999 Miller et al.
5,934,806 A 8/1999 Tomic et al.
5,950,285 A 9/1999 Porchia et al.
5,953,796 A 9/1999 McMahon et al.
5,955,160 A 9/1999 Tanaka et al.
5,964,532 A 10/1999 St. Phillips et al.
5,967,663 A 10/1999 Vaquero et al.
5,988,880 A 11/1999 Tomic
6,009,603 A 1/2000 Gallagher
6,010,244 A 1/2000 Dobreski et al.
6,014,795 A 1/2000 McMahon et al.
6,030,122 A 2/2000 Ramsey et al.
6,032,437 A 3/2000 Bois
6,050,726 A 4/2000 Hoerl
6,058,998 A 5/2000 Kristen
6,071,011 A 6/2000 Thomas et al.
6,074,096 A 6/2000 Tilman
6,077,208 A 6/2000 Larkin et al.
6,080,252 A 6/2000 Plourde
6,110,586 A 8/2000 Johnson
6,112,374 A 9/2000 Van Erden
6,135,636 A 10/2000 Randall
6,138,329 A 10/2000 Johnson
6,139,186 A 10/2000 Fraser
6,148,588 A 11/2000 Thomas et al.
6,149,302 A 11/2000 Taheri
6,152,600 A 11/2000 Tomic
6,156,363 A 12/2000 Chen et al.
6,164,825 A 12/2000 Larkin et al.
6,167,597 B1 1/2001 Malin
6,170,696 B1 1/2001 Tucker et al.
6,170,985 B1 1/2001 Shabram, Jr. et al.
6,187,396 B1 2/2001 Moller
6,210,038 B1 4/2001 Tomic
6,217,215 B1 4/2001 Tomic
6,217,216 B1 4/2001 Taheri
6,220,754 B1 4/2001 Stiglic et al.
6,221,484 B1 4/2001 Leiter
6,228,484 B1 5/2001 Willert-Porada et al.
6,228,485 B1 5/2001 Leiter
6,231,236 B1 5/2001 Tilman
6,257,763 B1 7/2001 Stolmeier et al.
6,279,298 B1 8/2001 Thomas et al.
6,286,681 B1 9/2001 Wilfong, Jr. et al.
6,286,999 B1 9/2001 Cappel et al.
6,293,701 B1 9/2001 Tomic
6,299,353 B1 10/2001 Piechocki et al.
6,318,894 B1 11/2001 Derenthal
6,321,423 B1 11/2001 Johnson
6,360,513 B1 3/2002 Strand et al.
6,371,643 B2 4/2002 Saad et al.
6,386,762 B1 5/2002 Randall et al.
6,394,652 B2 5/2002 Meyer et al.
6,398,411 B2 6/2002 Metzger
6,443,617 B2 9/2002 Tetenborg
6,461,042 B1 10/2002 Tomic et al.
6,461,043 B1 10/2002 Healey et al.
6,481,890 B1 11/2002 VandenHeuvel
6,487,758 B2 12/2002 Shaffer et al.
6,491,433 B2 12/2002 Shabram, Jr. et al.
6,533,740 B2 4/2003 Delisle
6,539,594 B1 4/2003 Kasai et al.
6,550,965 B2 4/2003 Shaffer et al.
6,550,966 B1 4/2003 Saad et al.
6,571,430 B1 6/2003 Savicki et al.
6,574,939 B1 6/2003 Heijnen et al.
6,581,249 B1 6/2003 Savicki et al.
6,582,122 B2 6/2003 Shimizu
6,592,260 B1 7/2003 Randall et al.
6,594,872 B2 7/2003 Cisek
6,637,937 B2 10/2003 Bois
6,637,939 B2 10/2003 Huffer
6,686,005 B2 2/2004 White et al.
6,691,383 B2 2/2004 Linton
6,692,147 B2 2/2004 Nelson
6,703,046 B2 3/2004 Fitzhugh et al.
6,712,509 B2 3/2004 Cappel
6,786,712 B2 9/2004 Cisek
6,789,946 B2 9/2004 Plourde et al.
6,854,886 B2 2/2005 Piechocki et al.
6,874,938 B2 4/2005 Price et al.
6,877,898 B2 4/2005 Berich et al.
6,953,542 B2 10/2005 Cisek
6,954,969 B1 10/2005 Sprehe
6,955,465 B2 10/2005 Machacek et al.
6,962,349 B2 11/2005 Notter et al.
6,994,535 B2 2/2006 Pawloski
7,004,632 B2 2/2006 Hamilton et al.
7,017,240 B2 3/2006 Savicki
7,036,988 B2 5/2006 Olechowski
7,087,130 B2 8/2006 Wu et al.
7,137,736 B2 11/2006 Pawloski et al.
7,163,706 B2 1/2007 Shepard et al.
RE39,505 E 3/2007 Thomas et al.
7,234,865 B2 6/2007 Piechocki
7,241,046 B2 7/2007 Piechocki et al.
7,260,871 B2 8/2007 Borchardt et al.
7,270,479 B2 9/2007 Nelson
7,305,742 B2 12/2007 Anderson
7,322,747 B2 1/2008 Borchardt
7,334,682 B2 2/2008 Goepfert
7,347,624 B2 3/2008 Savicki, Sr. et al.
RE40,284 E 5/2008 Thomas et al.
7,410,298 B2 8/2008 Pawloski
7,437,805 B2 10/2008 Berich
7,517,484 B2 4/2009 Wu
7,534,039 B2 5/2009 Wu
7,543,361 B2 6/2009 Borchardt et al.
7,553,082 B2 6/2009 Yoder
7,585,111 B2 9/2009 Turvey et al.
7,651,271 B2 1/2010 Withers
7,674,039 B2 3/2010 McMahon et al.
7,674,040 B2 3/2010 Dowd et al.
7,731,646 B2 6/2010 Leighton
7,736,058 B2 6/2010 Tanaka et al.
7,784,160 B2 8/2010 Dais et al.
7,806,594 B2 10/2010 Trinko
7,886,412 B2 2/2011 Dais et al.
7,942,577 B2 5/2011 Fraser et al.
8,061,898 B2 11/2011 Pawloski et al.
8,070,359 B2 12/2011 Taheri
8,075,186 B2 12/2011 Borchardt et al.
8,087,828 B2 1/2012 Noguchi et al.
8,202,002 B2 6/2012 McMahon et al.
8,376,614 B2 2/2013 Pawloski et al.
8,469,593 B2 6/2013 Price et al.
8,529,129 B2 9/2013 Turvey
8,568,031 B2 * 10/2013 Price ..... B65D 33/255
383/63
8,926,179 B2 1/2015 Ackerman
8,974,118 B2 3/2015 Pawloski
8,999,219 B2 4/2015 Plourde et al.
9,011,003 B2 4/2015 Pawloski
9,126,735 B2 * 9/2015 Price ..... B65D 33/255
9,156,593 B2 * 10/2015 Schreiter ..... B65D 33/255
9,260,225 B2 * 2/2016 Anzini ..... B29D 5/10
9,327,875 B2 * 5/2016 Pawloski ..... B65D 33/255
9,434,514 B2 9/2016 Ackerman
9,475,616 B2 * 10/2016 Price ..... B65D 33/255
10,011,396 B2 * 7/2018 Price ..... B65D 33/255
2002/0064582 A1 5/2002 Carabetta et al.
2002/0090151 A1 7/2002 Skeens et al.
2002/0153273 A1 10/2002 Mallik et al.

(56) References Cited

U.S. PATENT DOCUMENTS

| | | | |
|---|---|---|---|
| 2002/0173414 | A1 | 11/2002 | Leighton |
| 2003/0169948 | A1 | 9/2003 | Fenzl et al. |
| 2003/0177619 | A1 | 9/2003 | Cisek |
| 2003/0210836 | A1 | 11/2003 | Strand |
| 2003/0223654 | A1 | 12/2003 | Gerrits |
| 2003/0223657 | A1 | 12/2003 | Belias et al. |
| 2003/0232112 | A1 | 12/2003 | Whitmore et al. |
| 2004/0001651 | A1 | 1/2004 | Pawloski |
| 2004/0078939 | A1 | 4/2004 | Pawloski |
| 2004/0078940 | A1 | 4/2004 | Ishizaki |
| 2004/0086604 | A1 | 5/2004 | Grandey |
| 2004/0131283 | A1 | 7/2004 | Sprague et al. |
| 2004/0234171 | A1 | 11/2004 | Dais et al. |
| 2004/0234173 | A1 | 11/2004 | Saad et al. |
| 2004/0256761 | A1 | 12/2004 | Pawloski |
| 2005/0034427 | A1 | 2/2005 | Higer et al. |
| 2005/0063616 | A1 | 3/2005 | Chang |
| 2005/0141786 | A1 | 6/2005 | Piechocki et al. |
| 2005/0207679 | A1 | 9/2005 | Armstrong |
| 2005/0271308 | A1 | 12/2005 | Pawloski |
| 2005/0276524 | A1 | 12/2005 | Taheri |
| 2005/0281921 | A1 | 12/2005 | Langston et al. |
| 2005/0286810 | A1 | 12/2005 | Sprague et al. |
| 2005/0286811 | A1 | 12/2005 | Sprague et al. |
| 2005/0286812 | A1 | 12/2005 | Sprague et al. |
| 2006/0008187 | A1 | 1/2006 | Armstrong |
| 2006/0078232 | A1 | 4/2006 | Trinko |
| 2006/0165316 | A1 | 7/2006 | Cheung |
| 2006/0257533 | A1 | 11/2006 | Plourde et al. |
| 2007/0155607 | A1 | 7/2007 | Bassett et al. |
| 2007/0183692 | A1 | 8/2007 | Pawloski |
| 2007/0206888 | A1 | 9/2007 | Chang |
| 2008/0137995 | A1 | 6/2008 | Fraser et al. |
| 2008/0159662 | A1 | 7/2008 | Dowd et al. |
| 2008/0226202 | A1 | 9/2008 | Dais et al. |
| 2008/0226203 | A1 | 9/2008 | Dais et al. |
| 2008/0232722 | A1 | 9/2008 | Pawloski et al. |
| 2008/0285897 | A1 | 11/2008 | Taheri |
| 2008/0292222 | A1 | 11/2008 | Snoreck |
| 2009/0034885 | A1 | 2/2009 | McGruder |
| 2009/0052809 | A1 | 2/2009 | Sampson |
| 2009/0097781 | A1 | 4/2009 | Tang |
| 2009/0190860 | A1 | 7/2009 | Kettner et al. |
| 2009/0214141 | A1 | 8/2009 | Borchardt et al. |
| 2009/0232421 | A1 | 9/2009 | Turvey |
| 2009/0257685 | A1 | 10/2009 | Matias |
| 2009/0304311 | A1 | 12/2009 | Noguchi et al. |
| 2010/0014786 | A1 | 1/2010 | Pawloski et al. |
| 2010/0166341 | A1 | 7/2010 | McMahon et al. |
| 2012/0106874 | A1 | 5/2012 | Pawloski |
| 2015/0049962 | A1 | 2/2015 | Bois et al. |
| 2015/0367995 | A1 | 12/2015 | Turvey et al. |

* cited by examiner

RECLOSABLE POUCH HAVING A CLICKING CLOSURE DEVICE

This application is a continuation application of copending U.S. patent application Ser. No. 15/272,762, filed Sep. 22, 2016, which is a continuation application of U.S. patent application Ser. No. 14/813,326, filed Jul. 30, 2015, now U.S. Pat. No. 9,475,616, which is a continuation application of U.S. patent application Ser. No. 14/039,041, filed Sep. 27, 2013, now U.S. Pat. No. 9,126,735, which is a continuation of U.S. patent application Ser. No. 13/031,984, filed Feb. 22, 2011, now U.S. Pat. No. 8,568,031.

FIELD OF THE INVENTION

The present technology relates to closures for reclosable pouches. More specifically, the present technology is directed to a closure mechanism having a female closure element and a male closure element, wherein at least one of the female and male closure element has asymmetric deformation such that, upon engagement, a clicking sound and/or a clicking tactile response is generated more significantly from one side of the closure mechanism than the other side.

BACKGROUND OF THE INVENTION

Storage bags are well-known in the art. For example, ZIPLOC® brand bags provide a very good and useful reclosable storage bag for storing food or other material. Most storage bags include a first side panel and a second side panel, which side panels are sealed at the edges and bottom, forming the bag having an open top. These bags include reclosable closure mechanisms near the top portion or lips of the bag for opening and closing the bag. For example, U.S. Pat. No. 7,410,298 ("the '298 patent") assigned to S.C. Johnson Home Storage Inc., the assignee herein, discloses closure mechanisms for reclosable pouches.

The '298 patent discloses a disposable pouch having side walls. The pouch includes first and second closure mechanisms, also known as a double zipper. The first closure mechanism on the lip side comprises a first male closure element and a first female closure element, both of which are substantially symmetrical about a transverse centerline. The first male closure element includes an engagement number having two hook portions that extend from a base. The first female closure element includes a base within a first spaced leg and a second spaced leg extending therefrom. The first female closure element is adapted to receive the first male element when pressure is exerted on the closure elements by the user's fingers during closing of the bag.

The second closure mechanism on the bag side of the double zipper in the '298 patent includes a second male closure element and a second female closure element. The second female closure element is substantially the same as the first female closure element. However, the second male closure element includes an engagement member comprising a single hood portion that extends from a base. The second male closure element is substantially asymmetrical about a longitudinal centerline. The closure mechanisms are formed by extrusion.

The first closure mechanism of the '298 patent exhibits a clicking feel and sound when the bag is opened or closed. Such a clicking feel and sound are created by having intermittent deformations in the first male closure element. These deformed segments are also substantially symmetrical about the transverse centerline thereof. Another example of closure mechanisms with deformed segments is discussed in U.S. Pat. No. 5,140,727 issued on Aug. 25, 1992 to Dais et al. ("the '727 patent"). The deformed portions may be formed by opposing toothed gripper wheels. Such deformation provides for the clicking sound and/or feel when opening or closing the bag. However, the deformation may not provide for a substantially leak-proof seal, because the deformations or cuts may remove or damage the sealing surfaces.

On the bag side of the '298 patent, the second male element is not deformed and does not provide for a clicking sound and/or feel. The stem of the second male element is smooth and not deformed to provide an excellent seal. In theory, a good seal is formed between the second male closure element and the second female closure element by engagement of the ends of legs 260 and 262 with the stem of the male member so that potential leaks from poor sealing on the lip side closure mechanism are irrelevant.

SUMMARY OF THE INVENTION

While the current storage bag closure mechanisms have been tremendously successful in the market for storing food, and the like, there is room for improvement, including providing a closure mechanism having a male element that engages a female element, wherein at least one of the female and male elements is asymmetrically deformed to provide a clicking feel and/or sound more substantially from one side or even only from one side when the bag is opened and closed, yet still provide a substantially leak-proof seal.

The present technology is directed to a reclosable pouch comprising a first side wall, a second side wall, and a bottom portion that forms the bag with an open top portion for receiving and removing items to be stored, such as food or other material. The pouch further includes at least one closure mechanism near the open top of the bag that provides for a reclosable bag. The closure mechanism comprises a male closure element and a female closure element. The male closure element is asymmetrical and preferably includes one hook extending from an end thereof to engage the female closure element and is asymmetrically deformed to provide a clicking feel and/or sound when the pouch is closed. The male closure element in conjunction with the female closure element will provide a substantially leak-proof seal when the pouch is closed. In an alternative embodiment, the female closure element is asymmetrically deformed.

The present technology is further directed to a reclosable pouch comprising a body portion having first and second walls and first and second closure mechanisms. The first closure mechanism comprises a first male closure element and a first female closure element, wherein the first male and first female closure elements are disposed on opposing sides of the first and second walls. The second closure mechanism comprises a second male closure element and a second female closure element. The second female closure element has spaced legs and wherein the second male and second female closure elements are disposed on opposing sides of the first and second bag walls. The second male closure element includes an asymmetrical structure having one hook portion extending from an end therefrom to engage the second female closure element. The second male closure element includes deformations on one side thereof to provide a clicking feel and/or sound when the pouch is closed and provides a substantially leak-proof seal.

The present technology is further directed to a reclosable pouch comprising a body portion having first and second bag walls and first and second closure mechanisms. The first closure mechanism comprises a first male closure element that is substantially symmetric about a longitudinal centerline and a first female closure element, wherein the first female closure element has first and second spaced legs that are substantially symmetric along a longitudinal centerline, and wherein the first male and female closure elements are disposed on opposing sides of the first and second bag walls. The second closure mechanism comprises a second male closure element, and a second female closure element that is substantially identical to the first female element, wherein the second female closure element has third and fourth spaced legs, and wherein the second male and second female closure elements are disposed on opposing sides of the first and second bag walls. The first male closure element includes two hook portions extending from an end thereof to engage the legs of the first female closure element. The second male closure element is asymmetrical and includes one hook portion extending from an end thereof to engage the legs of the second female closure element. The second male closure element is intermittently deformed on at least one side thereof and provides for a clicking feel and/or sound when the pouch is closed. Preferably, the deformations are asymmetric. The novel second male closure element in conjunction with the second female closure element will provide a substantially leak-proof seal when the pouch is closed.

In another embodiment, the subject technology is directed to a reclosable pouch including a body portion having first and second bag walls and a closure mechanism. The closure mechanism includes an elongated male closure element having a base, a stem, and an engagement end, as well as a female closure element, wherein the female closure element has first and second spaced legs. The male and female closure elements are disposed on opposing sides of the first and second bag walls. The male closure element is constructed and arranged to engage the legs of the female closure element such that at least one of the male and female elements includes deformations only along one side to create at least one of a clicking feel and a clicking sound when the pouch is closed. In another embodiment, the deformations are intermittent and asymmetric. By asymmetric, it is meant that, without limitation, the deformations may be on only one side or on both sides, but more substantially to better create clicking or just differently shaped on the opposing side.

The deformations of the male element may be formed by a first toothed gripper wheel and a second smooth gripper wheel being deployed in an opposing manner to form a gap. The first toothed gripper wheel and the second smooth gripper wheel are at approximately 45° angles to form the gap that the male or female closure element passes through. For the male closure element, the gap is of a distance approximately equal to a width of the stem of the male closure element. The pouch may include a second closure mechanism that also creates the clicking sound and/or feel. Preferably, only the male element is deformed and the stem of the male element is substantially unchanged on an opposing side to the deformations to maintain an effective seal.

The subject technology is also directed to a reclosable pouch including opposing first and second walls joined together to form an interior for storing items and a closure mechanism including a male closure element coupled to the first wall and a female closure element coupled to the second wall. The male closure element has a proximal base adjacent first wall, a stem extending from the base, and a distal end. The male closure element defines a plurality of deformations. The female closure element has first and second spaced legs that define a channel. The male closure element is sized and arranged to interlock in the channel of the female closure element such that a clicking sound is generated at least mostly or even only by the plurality of deformations along one side of the stem during sealing of the closure mechanism. Preferably, during sealing, a clicking tactile cue is also generated by the plurality of deformations along the one side of the stem. The closure mechanism can include a similar or dissimilar pair of second female and male closure elements to be a double zipper configuration, each of which may or may not click as disclosed herein. The second pair of closure elements may also even generate a sound at an audibly different frequency from the first male closure element. Third, fourth, or any number of female and male pairs of closure elements may be provided to produce triple zippers, quad zippers, and so on. The male and female closure elements may be on the same bag walls, respectively, or variably spaced on different walls.

Another embodiment of the subject technology is directed to a reclosable pouch including first and second opposing walls joined to form a bag, each wall having a lip that forms part of an opening for the bag, and an elongated closure mechanism attached to the walls for sealing the opening. The closure mechanism has at least one female closure element and at least one male closure element having a plurality of deformed portions intermittent a normal portion. On a first side of the male closure element, the sealing surfaces are substantially unchanged from the normal to the deformed portions and gradual ramps define transitions between the normal and deformed portion. On a second side of the male closure element, transitions from the normal to the deformed portions are defined by a substantial step transition so that upon inserting the male closure element into the female closure element, the substantial step transitions create one of a clicking feel or a clicking sound.

A preferred length of the deformed portions is less than 0.15 of an inch {3.81 mm}. The male closure element includes a base and a stem extending from the base to terminate in an engagement feature. The sealing surfaces are substantially on the stem. The engagement feature has a cross-sectional shape selected from the group consisting of a hook, an arrow head, a three-lobed arrow head, a rounded stem, an asymmetrical triangle, and a symmetrical triangle. The female closure element may also define deformed portions having a relatively quiet side and a relatively loud sound producing side. The closure mechanism may be a double zipper that has female and/or male closure elements that produce sound at a different frequency from the first closure mechanism.

The different embodiments of the present technology will be apparent from the following description of the preferred embodiments of the invention and from the accompanying drawings.

BRIEF DESCRIPTION OF THE DRAWINGS

The following detailed description of specific non-limiting embodiments of the present invention can be best understood when read in conjunction with the following drawings, in which like structures are indicated with like reference numbers.

DETAILED DESCRIPTION OF THE PREFERRED EMBODIMENTS

Figure 1:
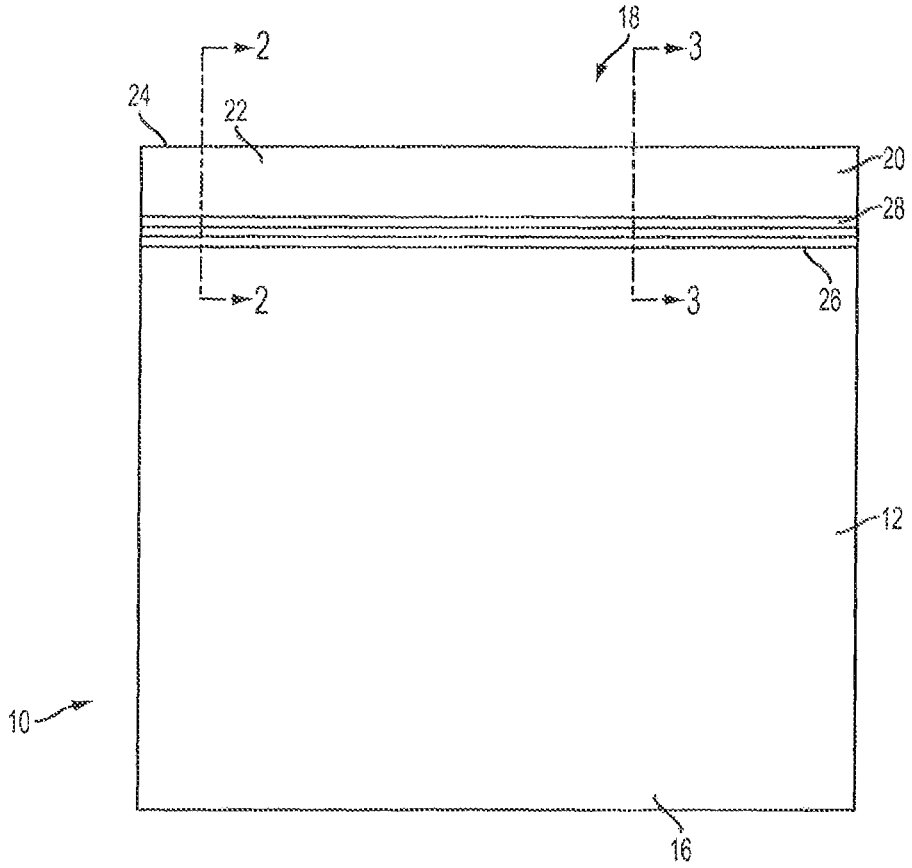
FIG. 1 is an elevational view of a reclosable thermoplastic storage bag incorporating the present technology.

The present disclosure overcomes many of the prior art problems associated with vented pouches and bags. The advantages, and other features of the technology disclosed herein, will become more readily apparent to those having ordinary skill in the art from the following detailed description of certain preferred embodiments taken in conjunction with the drawings, which set forth representative embodiments of the present invention and wherein like reference numerals identify similar structural elements.

All relative descriptions herein such as left, right, up, and down are with reference to the Figures, and not meant in a limiting sense. Unless otherwise specified, the illustrated embodiments can be understood as providing exemplary features of varying detail of certain embodiments, and therefore, unless otherwise specified, features, components, modules, elements, and/or aspects of the illustrations can be otherwise resized, combined, interconnected, sequenced, separated, interchanged, positioned, and/or rearranged without materially departing from the disclosed systems or methods. The shapes and sizes of components are also exemplary and unless otherwise specified, can be altered without materially affecting or limiting the disclosed technology. Additionally, the representations shown herein may be somewhat idealized in that manufacturing processes typically have variation and approximate the features, which can be drawn with clarity beyond that which can be made.

Referring now to FIG. 1, a perspective view of a reclosable pouch or thermoplastic storage bag 10 with a double zipper closure mechanism in accordance with the subject technology is shown. The pouch 10 is preferred by users, because the double zipper has a clicking feel and sound during opening and closing to provide assurance of proper closure.

The reclosable pouch or thermoplastic storage bag 10 comprises a first side wall 12, a second side wall 14 and a bottom portion 16, which when sealed forms bag 10 having an opening 18. Bag 10 includes a top portion 20 having two lips 22 disposed at top portion 20 and an upper edge 24. First and second closure mechanisms 26 and 28 are disposed at the top portion 20 of the bag 10. The first closure mechanism 26 is on the bag side and the second closure mechanism 28 is on the lip side. The bag 10 may be made of one or more plastic materials such as polypropylene, polyethylene, bioplastics, and mixtures thereof.

The thermoplastic storage bag 10 of the present technology may include other features and attributes such as disclosed in previously referenced U.S. Pat. No. 7,410,298. Other configurations and additional features are also possible without limitation such as shown in U.S. Pat. No. 5,070,584 issued to Dais et al. on Dec. 10, 1991, U.S. Pat. No. 6,692,147 issued to Nelson on Feb. 17, 2004, U.S. Pat. No. 6,962,349 issued to Taheri on Nov. 8, 2005, U.S. Pat. No. 6,010,244 issued to Dobreski et al. on Jan. 4, 2000, U.S. Pat. No. 7,736,058 issued to Tanaka et al. on Jun. 15, 2010, U.S. Pat. No. 7,322,747 issued to Borchardt on Jan. 29, 2008, and U.S. Pat. No. 7,674,039 issued to McMahon et al. on Mar. 9, 2010 as well as U.S. Patent Application Publ. No. 2004/0234171 to Dais et al. published on Nov. 25, 2004, U.S. Patent Application Pub. No. 2004/0234173 to Saad et al. published on Nov. 25, 2004, U.S. Patent Application Pub. No. 2007/0183692 to Pawloski published on Aug. 9, 2007, and U.S. Patent Application Publ. No. 2006/0008187 to Armstrong published on Jan. 12, 2006, which matured into U.S. Pat. No. 9,011,003.

Figure 3:
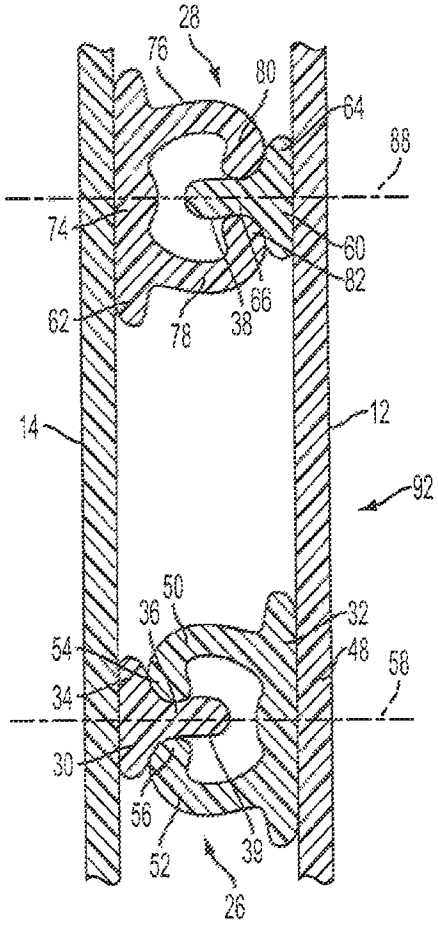
FIG. 3 is an enlarged, fragmentary, sectional view taken generally along lines 3-3 of FIG. 1 through a deformed segment.
Figure 2:
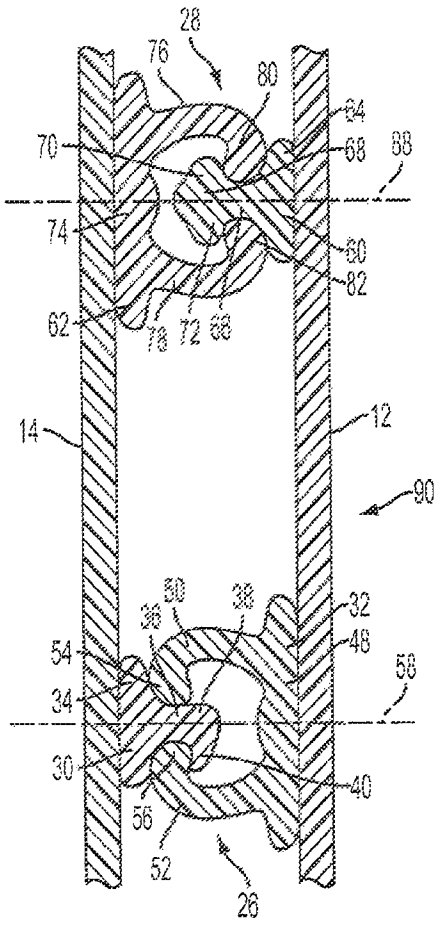
FIG. 2 is an enlarged, fragmentary, sectional view taken generally along lines 2-2 of FIG. 1 through a deformed segment.

Referring now to FIG. 2, an enlarged, fragmentary, sectional view taken generally along lines 2-2 of FIG. 1 through a normal segment 90 is shown. The closure mechanisms 26 and 28 are secured to the side walls 12 and 14. The closure mechanisms 26 and 28 are characterized by intermittent and preferably alternating first and second segments 90 and 92. The first segment 90, illustrated in FIG. 2, is referred to as "normal" in that the cross section remains unchanged from the extrusion formation process. However, the second segment 92, illustrated in FIG. 3, is referred to as being "deformed," because the second segment 92 is modified during the forming process by deformer wheels as discussed below.

The Normal Segments

Still referring to FIG. 2, closure mechanism 26 illustrates a preferred embodiment of the present technology and will be described in detail hereafter. Closure mechanism 26 includes a male closure element 30 and a female closure element 32. The male closure element 30 and female closure element 32 are in alignment when closed as shown and somewhat still aligned, albeit separated when the bag 10 is open.

The female closure element 32 comprises a base portion 48 and spaced legs 50 and 52 having hooked end portions 54 and 56. Female element 32 is generally C shaped. The female element 32 is symmetrical about a longitudinal centerline 58.

Male closure element 30 comprises a base portion 34, a stem portion 36, and an engaging portion 38 having a hook 40 facing the bag side. By having the hook 40, greater force will be required to open the bag 10 from within or by pulling on the walls 12 and 14 from the bag side as compared to the opening force required when utilizing the lips 20. However, effective sealing will occur between the hooked end portions 54 and 56 of the female closure element 32 and stem portion 36 of the male closure element 30. The engaging portion 38 of the male closure element 30 may also have a lateral member opposing the hook, e.g., facing the lip side.

Still referring to FIG. 2, closure mechanism 28 may be as disclosed in U.S. Pat. No. 7,410,298 as described above in the normal segments 90. More particularly, closure element 28 includes a male closure element 60 and a female closure element 62. Male closure element 60 comprises a base portion 64, a stem portion 66, and an engaging portion 68, which is a three-lobed arrowhead having lateral portions or hooks 70 and 72.

The female closure element 62 comprises a base portion 74 and spaced legs 76 and 78 having hooked end portions 80 and 82. Female element 62 is generally C shaped and symmetrical about a longitudinal centerline 88. As can be seen, the female closure element 62 is the same as female closure element 32, but positioned on the opposing wall 14. In addition to single zipper configurations, female closure elements 32 and 62 and male closure elements 30 and 60 may be any combination of hooks, arrows, variations as noted above, and otherwise configured and arranged on the walls 12 and 14.

The Deformed Segments

Referring now to FIG. 3, an enlarged, fragmentary, sectional view taken generally along lines 3-3 of FIG. 1 through a deformed segment 92 is shown. As can be seen, in the deformed segments 92, the male closure elements 30 and 60 still engage the female closure elements 32 and 62. Although the female closure elements 32 and 62 are unchanged, the male closure elements 30 and 60 have been asymmetrically deformed. In a brief overview, in a preferred embodiment, the sealing surface or stem portion 36 on one side has remained intact, whereas the sealing surface/stem portion 36 has been modified on the opposing side.

In the deformed segments 92 of the first closure mechanism 26, the engaging portion 38 and the stem 36 of the male closure element 30 have been reshaped, but the base has remained substantially unchanged. The deformation of the stem 36 is more pronounced on the bag side than the relatively minor amount of deformation, if any, on the lip side, such that the sealing surfaces remain intact on the lip side. On the bag side, however, the stem 36 has been deformed or notched. The hook 40 is no longer pronounced and a width W of the engaging portion 38 (seen in FIG. 7A discussed below) is approximately equal to the width of the stem 36. The bag side of the male closure element 30 is notched inward from just above the base 34 to the engaging portion 38. As a result, the sealing surface of the stem 36 has been impacted, and a gap 39 may exist on the bag side between the male closure element 30 and the female closure element 32. In another embodiment, the stem portion 36 remains substantially unchanged so that the sealing surfaces are maintained intact on both sides of the male closure element.

By maintaining the stem 36 on the lip side relatively unchanged, the leg 50 still effectively seals onto the lip side of the stem 36 of the male closure element 30. The contact between the leg 52 and the bag side of the stem 36 may also seal, but due to the deformation, the seal may be ineffective or perform to a lesser degree than desired. Although there may not be an effective seal on the bag side, the first closure mechanism 26 maintains the seal by virtue of the sealing surface engaging normally on the lip side. In an alternative embodiment, the hook 40 points to the lip side and the hook 40 is still relatively more deformed, and vice versa. It is also envisioned that only one of the closure mechanisms 26 and 28 may have deformed portions, such that one of the closure mechanisms 26 or 28 maintains intact on sealing. In another embodiment, the lip side(s) of the closure elements maintain seal integrity and the bag sides are substantially more deformed.

Still referring to FIG. 3, in the deformed segments 92 of the second closure mechanism 28, the second male closure element 60 has also been asymmetrically deformed. The lateral members 70 and 72 have been reshaped, but the base 64 has remained relatively unchanged. On the lip side, the stem portion 66 has remained relatively unchanged or only subject to minor deformation, but on the bag side, the step portion 66 has been deformed. As seen in FIG. 7B and discussed below, the width W of the engaging portion 68 is substantially the same as the width of the stem portion 66. Preferably, the engaging portion 68 and stem portion 66 have the same basic shape in the deformed segments 92. By maintaining the stem 66 relatively unchanged, the leg 78 is able to effectively seal thereto on the bag side to provide a second effective seal on the bag side of the second closure mechanism 28. The other leg 76 may also effectively seal against the stem 66 of the male closure element 60 in the deformed segments 92, depending upon the degree of deformation, if any, of the stem 66 on that side.

Preferably, a ratio of the length of the deformed segments 92 to the length of the normal segments 90 is approximately one. Typically, the length of the segments 90 and 92 is less than about 0.175 of an inch {4.44500 mm} so that a plurality of deformed segments 92 is depressed by one's fingers during venting as described below. In one embodiment, the length of the segments 90 and 92 is about 0.15 of an inch {3.81 mm}. In alternative embodiments, the normal segments 90 are significantly longer than the deformed segments 92, or vice versa. In another embodiment, the lengths of the segments 90 and 92 vary. By varying the lengths of the segments 90 and 92, different frequency sounds may be created. Hence, the closure mechanisms 26 and 28 may create different audible sounds and tactile cues.

A Process and an Apparatus for Making the Double Zipper

Double zippers of the subject technology may be extruded and post-applied or extruded with the pouch as is known in the art. After formation, the male closure elements 30 and 64 are processed through a deforming apparatus to create the deformed segments 92. The deforming apparatus typically uses an identical pair of matched deformer rings. See, for example, U.S. Pat. No. 5,140,727, issued to Dais et al. on Aug. 25, 1992, and U.S. Pat. No. 5,647,100, issued to Porchia et al. on Jul. 15, 1997. The subject technology, however, uses different deformer rings to create different effects on opposing sides of the same profile. Various combinations and configurations may be used, such as shown in U.S. patent application Ser. No. 12/916,005, filed Oct. 29, 2010, published as U.S. Patent Application Publication No. 2012/0106874 on May 3, 2012, and which matured into U.S. Pat. No. 8,974,118.

Figure 4A:
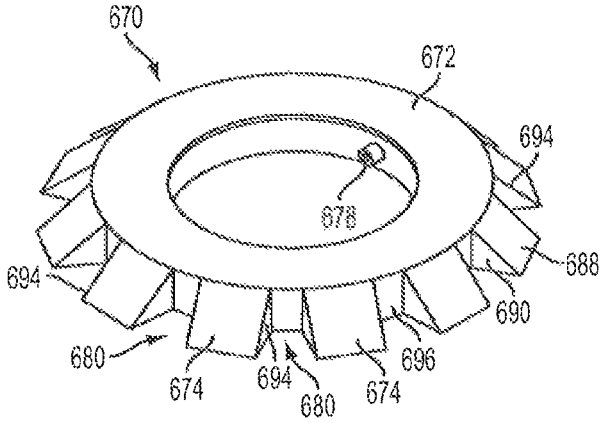
FIG. 4A is a perspective view of a toothed gripper wheel or deformer ring for use in a deforming apparatus to manufacture a closure mechanism in accordance with the subject technology.
Figure 4B:
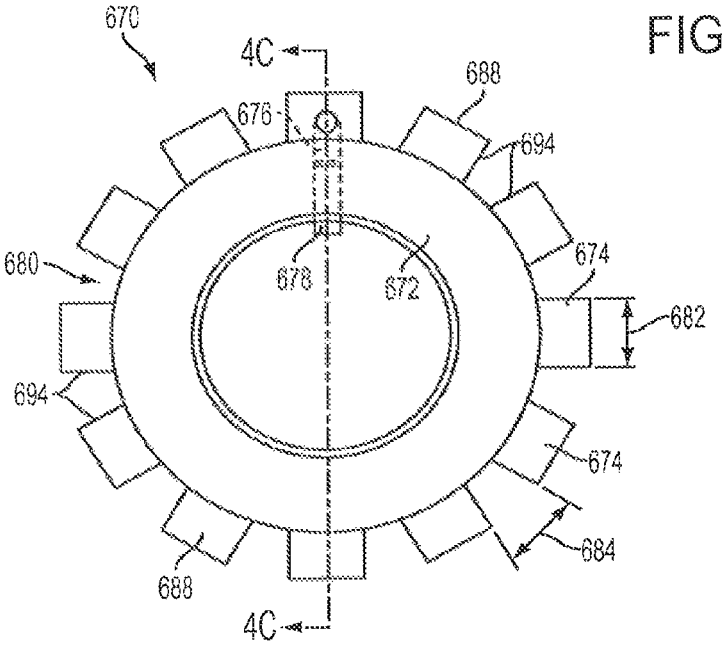
FIG. 4B is a top view of the deformer ring of FIG. 4A.
Figure 4C:
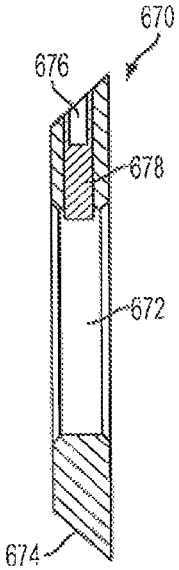
FIG. 4C is a cross-sectional view of the deformer ring of FIG. 4A taken along line 4C-4C of FIG. 4B.

Now, referring to FIGS. 4A to 4C, perspective, top, and cross-sectional views of one deformer ring 670 for use in a deforming apparatus (not shown) in accordance with the subject technology are shown. The deformer ring 670 has an annular body 672 with a plurality of teeth 674 formed on an outer circumference thereof. The teeth 674 have an angled surface 688 that applies pressure to deform the male closure element. The angled surfaces 688 also form cutting edges 694 that notch the male closure element. Intermediate the angled surfaces 688 are sidewalls 690 and inner walls 696 that do not engage the profile being worked.

A thoroughbore 676 is formed in the annular body 672 to receive a dowel 678, which facilitates mounting the deformer ring 670 to the deforming apparatus. The teeth 674 are separated by gaps 680, which create a tooth arc length 682 and a gap arc length 684 on the outermost portion of the deformer ring 670. In use, the tooth arc length 682 and the gap arc length 684 form the normal and deformed segments 90 and 92, respectively, in the male closure elements.

In one embodiment, the tooth arc length 682 and the gap arc length 684 are approximately equal, but either may be longer than the other. Preferably, the tooth arc length 682 and the gap arc length 684 are about 0.15 of an inch {3.81 mm} or less. In another embodiment, the gap arc length 682 is less than about 0.175 of an inch {4.44500 mm} and the tooth arc length 684 is about 0.148 of an inch {3.75920 mm}. In another embodiment, multiple toothed deformer wheels 670 are available for different tooth arc and gap arc lengths 682 and 684. In one embodiment, a ratio of the tooth arc lengths between the different deformer wheels 670 is selected from the group of ratios of approximately 1.5, 2, 3, and 4. In still another embodiment, the tooth arc length 682 and the gap arc length 684 are irregular or vary according to a pattern.

Figure 5A:
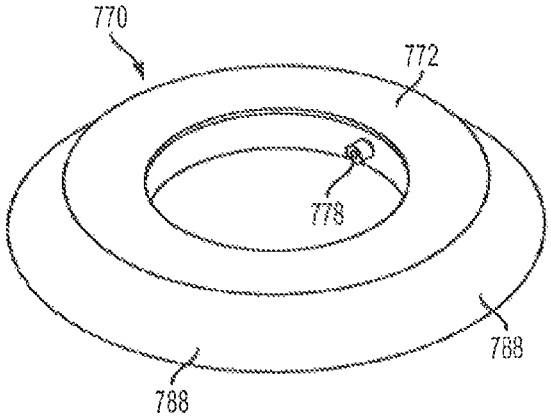
FIG. 5A is a perspective view of a smooth gripper wheel or deformer ring for use in a deforming apparatus to manufacture a closure mechanism in accordance with the subject technology.
Figure 5B:
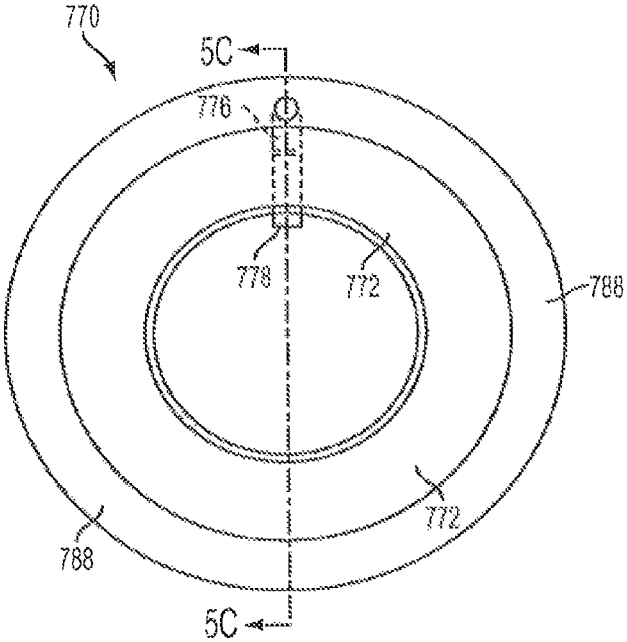
FIG. 5B is a top view of the deformer ring of FIG. 5A.
Figure 5C:
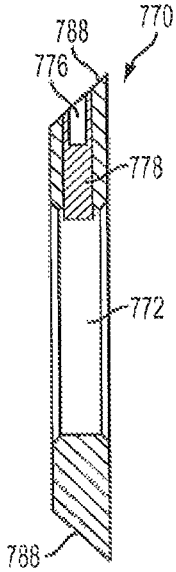
FIG. 5C is a cross-sectional view of the deformer ring of FIG. 5A taken along line 5C-5C of FIG. 5B.

Now referring to FIGS. 5A to 5C, perspective, top, and cross-sectional views of another deformer ring 770 for use in a deforming apparatus (not shown) with the deformer ring 670 in accordance with the subject technology are shown.

As will be appreciated by those of ordinary skill in the pertinent art, the deformer ring 770 is structurally similar to the deformer ring 670 described above. Accordingly, like reference numerals preceded by the numeral "7" instead of the numeral "6", are used to indicate like elements. The primary difference of deforming ring 770 in comparison to the deforming ring 670 is that the deformer ring 770 has an annular body 772 with a uniform angled surface 788 formed on an outer circumference thereof. The angled surface 788 also applies pressure to deform the male closure element, but without teeth. As a result, the deformer ring 770 has an attenuated effect as shown in FIGS. 7A and 7B discussed below.

The deformer rings 670, 770 and technology related to the same may also be implemented in any deforming apparatus now known and later developed. One apparatus or process for making a male closure element for a reclosable thermoplastic bag in accordance with the subject technology would include an extruder for providing a longitudinally extending profile of a substantially uniform shape as shown in the normal segments 90 above.

Figure 6:
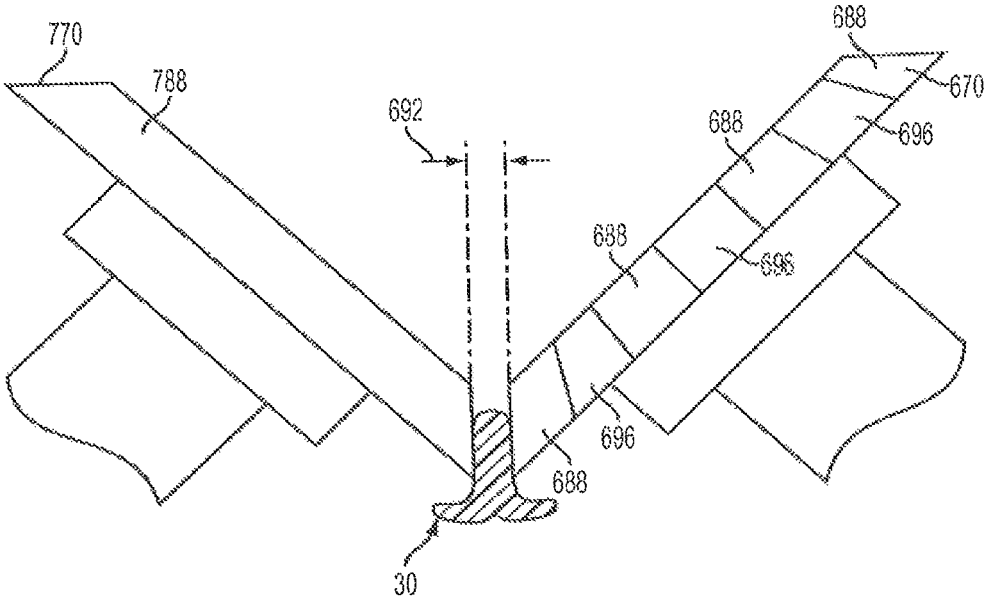
FIG. 6 illustrates the toothed gripper wheel and the smooth gripper wheel of FIGS. 4A and 5A in forming a male element of the closure mechanism of the present technology.

As shown in FIG. 6, the deforming apparatus includes the deformer rings 670 and 770 arranged in opposition to work the male closure elements 30 and 60. The angled surfaces 688 and 788 of the deforming rings 670 and 770 are set parallel and apart a gap 692 approximately equal to a cross-sectional width of the stem 36, plus or minus about 0.001 or 0.002 of an inch {0.0254 to 0.0508 mm}. Thus, as the male closure element 30 passes through the gap 692 at any linespeed, force from the deformer rings 670 and 770 creates compression and deformation of the male closure element 30. The engaging portion 38 is deformed into the male closure element 30. The second male closure element 60 is defined by a similar operation. In one embodiment as shown, the teeth 674 create cuts or notches in the stem portion 36 of about 0.002 inches {0.0508 mm}. In another embodiment, the stem portion 36 is relatively unchanged.

Figure 7A:
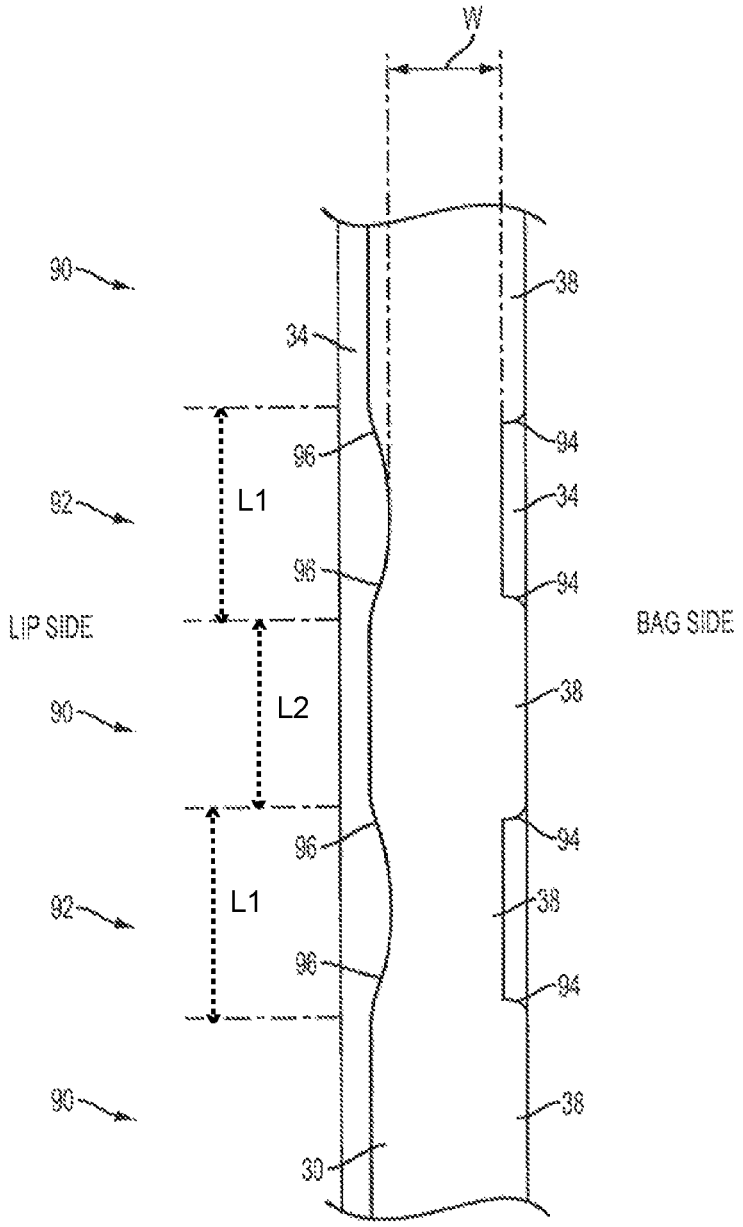
FIG. 7A is a top view of an exemplary male closure element having a normal asymmetric hook type configuration after having been deformed by the toothed smooth gripper wheels in accordance with the subject technology.
Figure 7B:
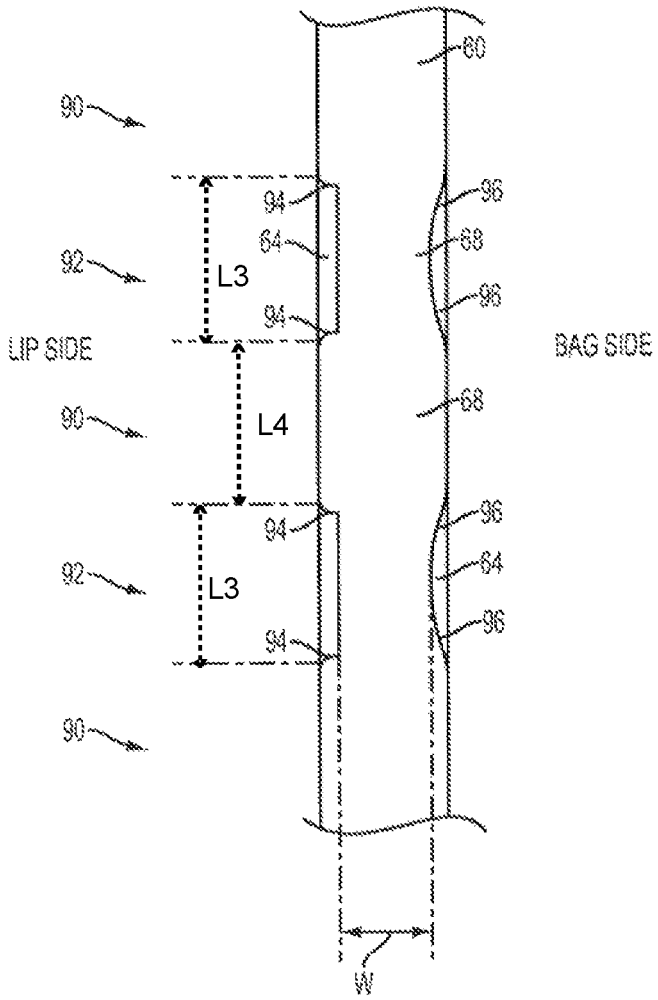
FIG. 7B is a top view of an exemplary male closure element having a normal symmetric arrow head type configuration after having been deformed by the toothed smooth gripper wheels in accordance with the subject technology.

Referring now to FIGS. 7A and 7B, top views of exemplary male closure elements 30 and 60 having arrow head and hook type configurations are shown. The male closure elements 30 and 60 have been deformed by opposing toothed and smooth gripper wheels 670 and 770. FIGS. 7A and 7B are somewhat schematic to illustrate concepts and varying configurations that could result depending upon processing parameters and ring configurations, as would be appreciated by those of ordinary skill in the pertinent art.

In the normal segments 90 of the male closure elements 30 and 60, the male closure elements 30 and 60 are unchanged despite having passed through the gap 692. The normal segments 90 are created by passing between the deformer ring 670 corresponding to the gaps 680, such that the only angled surface 788 of the opposing smooth deformer ring 770 makes contact with the male closure elements 30 and 60. The male closure elements 30 and 60 simply deflect from contact by only the single deformer ring 770 and remain unchanged.

However, as the cutting edges 694 and angled surfaces 688 contact the male closure elements 30 and 60, compression and deformation of the male closure elements 30 and 60 occur, which is particularly distinct on the side of the toothed deformer ring 670. On the toothed deformer wheel side (e.g., shown as the right side in FIG. 7A and the left side in FIG. 7B), the cutting edges 694 create fairly crisp steps or notches as transitions 94 between the normal and deformed segments 90 and 92. However, on the side of the smooth deformer wheel 770 (e.g., the left side in FIG. 7A and the right side in FIG. 7B), gradual ramps 96 as transitions occur while the stem 36 and 66 remain substantially unchanged.

Without being limited to any particular theory, during opening and closing of the double zipper in accordance with the subject technology, the female legs 50, 52, 76, and 78 snap into and out of the deformed segments 92 along the notch transitions 94, to create an audible sound as well as tactile clicking. The notch transitions 94 are structurally modified such that the seal integrity between the stem 36 and 66 and female legs 50, 52, 76, and 78 is maintained, but weakened. On the smooth deformer wheel side, however, the female legs 50, 52, 76, and 78 slide across the ramps 96 in a relatively smoother and quieter manner, if not substantially click-free, while fully maintaining the seal integrity in either case. Thus, by having a combination of notch transitions 94 and ramps 96 on opposing sides, closure mechanisms can produce desirable clicking sounds and/or clicking tactile responses on one side, while maintaining excellent seal integrity on the other side.

Depending upon various fabrication techniques, the transitions between the segments 90 and 92 may vary to a certain degree. It is envisioned that the clicking sound and/or feel will be substantially generated on one side, whereas the other side will remain relatively smooth and, therefore, quiet, so that effective sealing is guaranteed. In one embodiment, at least a portion of the notch transitions 94 has an angular wall change of at least seventy-five degrees from the longitudinal axis of the elongated male closure element. In contrast, the ramps 96 have an angular wall change of no more than forty-five degrees. In another embodiment, the angular wall change of the notch transitions 94 is from about eighty to ninety degrees, and the ramps 96 is from about twenty-five to thirty-five degrees. In a preferred embodiment, the notch transitions 94 are approximately ninety degrees and the ramps 96 are less than about thirty degrees.

In an alternative embodiment, each side produces a clicking sound and/or clicking tactile response, but to varying degrees, due to the difference in deformation. The female profiles may also be deformed, just the female profiles, just a pair of a female and male profile, or even a single profile is deformed, and the like, depending upon the desired effect. For another embodiment, different deformer wheels are utilized to produce clicking sounds of varying frequencies from varying sides of the profiles. As can be seen, three types of closure mechanisms can be used in any combination. For example, on a double zipper, one could use any of a traditional sealing structure without any deformed segments, a clicking structure in accordance with the '298 and '727 patents, and clicks substantially from one side as disclosed herein. Hence, for a double zipper, nine different combinations are possible to yield various combinations of sealing and clicking structures as desired. Further, separation between the closure mechanisms may be such that a double zipper could be used when the user may only selectively engage one of the zippers. Additionally, venting closure mechanism and methods as disclosed in U.S. patent application Ser. No. 13/031,843 filed on Feb. 22, 2011, and which matured into U.S. Pat. No. 8,469,593, may be utilized.

The present technology is useful in storage bags and provides an improved closure mechanism. The present technology provides a closure mechanism having an improved substantially leak-proof seal utilizing asymmetric deformations on portions thereof to create a clicking sound and/or feel upon opening and closing of the bag. Male profiles that terminate in arrow head and hook configurations, as well as other forms, may be utilized in any combination. For example, hook portions may be employed so that the closure mechanism has a closing force that varies depending upon the direction and/or between each element of a double zipper. The subject technology may also be applied to single zipper closure mechanisms or just one or two parts of a double zipper closure mechanism. In one embodiment, the closing force of the closure mechanisms is in a range of about 0.20 lb. to about 0.30 lb. In another embodiment, the hook portions extend in opposite directions, outward from the closure mechanism and, in another, the hook portions extend in the same direction towards the bag or the lip side.

INCORPORATION BY REFERENCE

All patents, patent applications, and other references disclosed herein are hereby expressly incorporated in their entireties by reference.

The exemplary embodiments disclosed herein are not intended to be exhaustive or to unnecessarily limit the scope of the technology. The exemplary embodiments were chosen and described in order to explain the principles of the present technology so that others skilled in the art may practice the present technology. As will be apparent to one skilled in the art, various modifications can be made within the scope of this description. Such modifications, being within the ability of one skilled in the art and forming a part of the present technology, are embraced by the appended claims.

We claim:

1. A reclosable pouch comprising:

(A) a body portion having:

(a) a top portion;

(b) a bottom portion;

(c) a first wall that extends from the bottom portion to the top portion; and (d) a second wall that extends from the bottom portion to the top portion, the second wall opposing the first wall, and the second wall being joined to the first wall to form an interior of the pouch with an opening to the interior;

(B) a male closure element coupled to the first wall, the male closure element having a first side facing the bottom portion of the pouch and a second side facing the top portion of the pouch, the male closure element defining a plurality of deformed segments and a plurality of normal segments along a length thereof, the plurality of deformed segments being formed by reshaping at least a portion of the male closure element on at least one of the first side and the second side of the male closure element, and the plurality of deformed segments alternating with the plurality of normal segments, with (i) first transitions all along one of the first side and the second side of the male closure element between the plurality of deformed segments and the plurality of normal segments, with the first transitions only being positioned along the one of the first side and the second side of the male closure element, and (ii) second transitions all along the other of the first side and the second side of the male closure element between the plurality of deformed segments and the plurality of normal segments, with the second transitions only being positioned along the other of the first side and the second side of the male closure element, and the second transitions differing from the first transitions; and (C) a female closure element coupled to the second wall, the female closure element being configured to engage with the male closure element to seal the opening of the pouch, wherein the deformed segments of the male closure element generate a sound when the female closure element engages with the male closure element to seal the opening of the pouch, with the sound being generated due to (i) the second transitions differing from the first transitions and (ii) the positioning of the second transitions.

2. A reclosable pouch as recited in claim 1, wherein the first transitions comprise gradual transitions all along the one of the first side and the second side of the male closure element, and the second transitions comprise steep transitions all along the other of the first side and the second side of the male closure element.

3. A reclosable pouch as recited in claim 1, wherein the male closure element has (i) a proximal base adjacent to the one of the first and second walls, (ii) a stem extending from the base, and (iii) a distal end.

4. A reclosable pouch as recited in claim 1, wherein the female closure element has first and second spaced legs that define a channel, with the male closure element interlocking in the channel of the female closure element.

5. The reclosable pouch as recited in claim 1, wherein the plurality of deformed segments of the male closure element is formed by a toothed gripper wheel and a smooth gripper wheel being deployed in an opposing manner to form a gap between the wheels, in which the male closure element can be received.

6. The reclosable pouch as recited in claim 5, wherein the toothed gripper wheel and the smooth gripper wheel are at approximately forty-five degree angles relative to each other, and the gap between the wheels is constructed and arranged to receive the male closure element to provide the deformed segments therein.

7. The reclosable pouch as recited in claim 6, wherein the male closure element includes a stem having a width, such that the gap is of a distance less than the width of the stem of the male closure element, so that the stem is deformed substantially only on a side of the stem acted upon by the toothed gripper wheel.

8. The reclosable pouch as recited in claim 1, wherein the deformed segments of the plurality of deformed segments of the male closure element are formed by:

(i) an engagement end of the male closure element being reshaped on one side of the male closure element;

(ii) a base of the male closure element being substantially unchanged; and (iii) a stem of the male closure element being substantially unchanged on a second side of the male closure element.

9. The reclosable pouch as recited in claim 1, wherein engaging the female closure element with the male closure element to seal the opening of the pouch generates a clicking feel.

10. The reclosable pouch as recited in claim 1, wherein a length of at least one of the deformed segments of the male closure element is less than 0.15 of an inch.

11. The reclosable pouch as recited in claim 1, wherein the male closure element comprises a base and a stem that extends from the base to terminate in an engagement end, the engagement end having a cross-sectional shape selected from the group consisting of a hook, an arrow head, a three-lobed arrow head, a rounded stem, an asymmetrical triangle, and a symmetrical triangle.

12. The reclosable pouch as recited in claim 11, wherein the stem of the male closure element has sealing surfaces.

13. The reclosable pouch as recited in claim 1, wherein the male closure element comprises asymmetric deformations in each of the deformed segments, the asymmetric deformations being capable of generating the sound when the female closure element engages with the male closure element.

14. The reclosable pouch as recited in claim 13, wherein each of the asymmetric deformations comprises:

(i) a distal end of the male closure element being reshaped on one side of the male closure element;

(ii) a base of the male closure element being substantially unchanged; and (iii) a stem of the male closure element being substantially unchanged on a second side of the male closure element.

15. A reclosable pouch as recited in claim 1, further comprising a second male closure element and a second female closure element coupled to opposing sides of the first and second bag walls, respectively, wherein the second female closure element is configured to engage with the second male closure element to further seal the opening of the pouch.

16. A reclosable pouch as recited in claim 15, wherein the male closure element has deformed segments of a first length, and the second male closure element has deformed segments of a second length, the second length being different than the first length.

17. A reclosable pouch as recited in claim 15, wherein the second male closure element comprises asymmetric deformations, the asymmetric deformations being capable of generating a second sound when the second female closure element engages with the second male closure element.

18. A reclosable pouch as recited in claim 17, wherein engaging the female closure element with the male closure element generates the sound at a first audible frequency, and engaging the second female closure element with the second male closure element generates the second sound at a second audible frequency.

19. A reclosable pouch as recited in claim 18, wherein the second audible frequency differs from the first audible frequency.

20. A reclosable pouch as recited in claim 17, wherein engaging the second female closure element with the second male closure element to seal the opening of the pouch generates a clicking feel.

21. A reclosable pouch as recited in claim 1, wherein the sound that is generated when the female closure element engages with the male closure element indicates a proper closure of the opening of the pouch.

* * * * *